US005617904A

United States Patent [19]

Kälin

[11] Patent Number: 5,617,904

[45] Date of Patent: Apr. 8, 1997

[54] TEXTILE SUBSTRATE FOR SEAT COVERS

[75] Inventor: Albin Kälin, Widnau, Switzerland

[73] Assignee: Rohner Textil AG, Balgach, Switzerland

[21] Appl. No.: 453,889

[22] Filed: May 30, 1995

[30] Foreign Application Priority Data

May 30, 1994 [CH] Switzerland ..... 01 670/94

[51] Int. Cl.[6] ..... D03D 15/00

[52] U.S. Cl. ..... 139/420 R; 139/420 A; 139/426 R; 442/184; 442/209; 442/211; 442/214

[58] Field of Search ..... 428/225, 229, 428/253, 257, 258, 259; 139/420 A, 420 R, 426 R

[56] References Cited

U.S. PATENT DOCUMENTS 5,070,915 12/1991 Kalen ..... 139/420 R
5,167,264 12/1992 Kalen ..... 139/420 R

FOREIGN PATENT DOCUMENTS 342813 1/1927 Belgium .
356708 3/1990 European Pat. Off. .
455848 11/1991 European Pat. Off. .

*Primary Examiner*—James J. Bell
*Attorney, Agent, or Firm*—Cushman Darby & Cushman IP Group of Pillsbury Madison & Sutro LLP

[57] ABSTRACT

A textile substrate for seat covers, a woven fabric or a knitted fabric, especially Raschel or Malimo, contains at least 40% by weight of wool and at least 15% by weight of ramie, but always more than 85% by weight of both taken together. The substrate can consist exclusively of wool and ramie but can also contain further constituents, preferably of animal or vegetable origin such as cotton, linen, hemp or else natural rubber. To obtain antistatic properties, it can contain incorporated metal threads. Minor proportions of synthetic fibres, for example polyester, are also possible. The substrate can be formed for example as a woven fabric with a blend yarn (1) of 80% by weight of wool and 20% by weight of ramie in the warp and ramie threads (2) in the weft. Textile substrates of the kind described offer on account of their excellent water absorption and transport properties high comfort as seat covers especially even over seats which are frequently used for a long period without interruption such as wheelchairs, seats in cars and buses, in trains and in aircraft and also office chairs. On account of their composition, the fabrics are also disposable in a very environmentally benign manner, since comminuted and kept at sufficiently high moisture and temperature they rot down substantially or—in particular when consisting exclusively of natural fibre—completely and are thus compostable.

12 Claims, 1 Drawing Sheet

TEXTILE SUBSTRATE FOR SEAT COVERS

BACKGROUND OF THE INVENTION

EP-A-0 356 708 discloses a congeneric textile substrate where the proportion of natural fibres, in particular wool and ramie, is between 65 and 85% by weight. Such substrates are noted for their excellent ability to absorb and transport water in vapour and in liquid form, which makes them particularly suitable for seat covers, in particular covers on seat facilities used for long periods without interruption such as car and aircraft seats, wheelchairs, office chairs, etc., since the efficient moisture transport away from the fabric surface stops the seat cover feeling moist and impairment of seat comfort.

EP-A-0 455 848 discloses congeneric textile substrates where the proportion of synthetic fibres is between 45 and 65% by weight and which contain in particular at least 40% by weight of wool and at least 5% by weight of ramie. Otherwise they contain at least 35% by weight of natural fibres, normally more, so that they are even better qualified to meet the latest demand, namely the demand for good colour design options.

On the other hand, a high proportion of synthetic fibres normally means that corresponding substrates are difficult to dispose of as waste and for that reason are not ideal in meeting the increasing demands for environmental compatibility.

Moreover, it was extremely dubious whether a substantial or complete abandonment of synthetic fibres would not restrict the design possibilities of the fabric designer too severely and in particular would impair the excellent properties of known congeneric textiles as regards water absorption and transport. The first problem is less serious and can be circumvented through appropriately adapted, more natural colouring.

As regards liquid transport, however, it appeared to be essential from previous results to provide a relatively high proportion—at least 15% by weight—of synthetic fibres, preferably polyester, since their hydrophobic properties appeared to be an essential condition for liquid transport over relatively great distances.

SUMMARY OF THE INVENTION

However, it has surprisingly been found that the same function is performed by the ramie fibre when it is present in the substrate in sufficient concentration—at least 15% by weight. This was unforeseeable from its chemical composition: degummed ramie consists essentially of cellulose. True, ramie had been found to play a part in the transport of water from wool to synthetic fibre such as polyester, but this could also have been ascribed to moderately hydrophilic properties of the fibre surface which do not constitute a basis for water transport over relatively great distances.

That ramie is capable of transporting water even over relatively great distances is probably due to the only recently discovered fact that ramie fibres are hollow. They form tubes which have a longitudinal grooving on the inner surface. This is the reason for a powerful capillary effect which is apparently responsible for the long-distance transport of water.

At any rate, the discovery of the ability of the ramie fibre to transport water over great distances is the basis for a surprisingly simple solution to the problem of providing a textile substrate for seat covers which is not only extremely comfortable, in that it always feels dry even under prolonged uninterrupted use under difficult conditions such as high temperatures and high atmospheric humidity, but also has very little adverse impact on the environment, is in particular readily disposable and under suitable condition rots with at most minimal residues requiring disposal. Substrates according to the invention can generally be properly composted by exposing them to adequate moisture and temperature following comminution and subsequent piling up.

The textile substrate can moreover have been formed in various ways, as a woven or knitted fabric, especially as a Raschel or Malimo fabric.

BRIEF DESCRIPTION OF THE DRAWING

Preferred embodiments of the invention, described below, are schematically depicted in the drawing, where in each case the weft direction is horizontal and which.

DETAILED DESCRIPTION

The substrate according to the invention consists of at least 40% by weight of wool and at least 15% by weight of degummed ramie, the sum of the proportions of wool and ramie amounting to more than 85% by weight. As to the rest, it preferably consists exclusively of substances which rot, so that it is compostable without restriction. Even under these conditions it can be finished to meet a variety of requirements. For example, to prevent static charge build-up it can contain metal fibres or wire, preferably not more than 5% by weight. If they are appropriately chosen, they will oxidize under suitable conditions and thus rot together with the other constituents. Even the use of elastic fibres is entirely possible, since their proportion if they do not rot as is the case for example with Lycra® (registered trademark of DuPont de Nemours) can be kept very low—to not more than 5% by weight—or otherwise rottable material such as natural rubber can be used. Elastic fibres can have been incorporated for example into the substrate by individual threads consisting completely of such material or a yarn, for example in the weft of a woven fabric, which consists essentially of ramie being overwrapped with elastic fibres.

Although synthetic fibres such as polyester, polypropylene, polyamide, polyacrylic or aramid are not especially troublesome in low proportions, in the interests of unrestricted compostability it is preferable to do without them, so that all the fibres used—apart from a possible admixture of metal fibres—are of animal or vegetable origin. Besides wool and ramie, which are always present, suitable fibres include for example cotton, linen, staple viscose and hemp.

It is very advantageous for the substrate to contain a blend yarn with wool and ramie, preferably a blend yarn which consists of about 80% by weight of wool and 20% by weight of ramie. In the case of a woven fabric it is possible, for example, for the warp or weft to consist of such a blend yarn and for the corresponding weft or warp, by contrast, to consist of another material, for example pure ramie. In the case of these and other substrates it has proved possible and even advantageous to use only wool and ramie and to dispense with other admixtures completely, unless they are necessary for special requirements.

Figure 1:
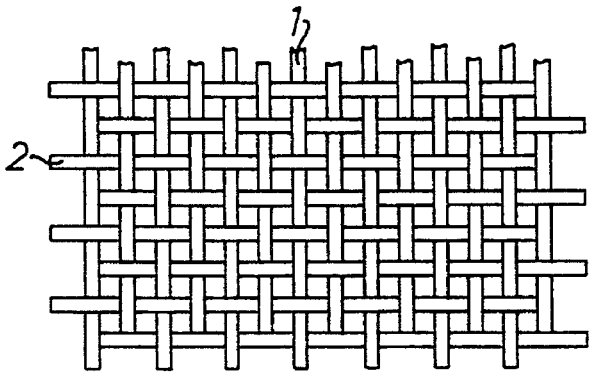
FIG. 1 shows a woven fabric.

For instance, FIG. 1 shows a woven fabric according to the invention whose warp is formed of a blend yarn 1 with 80% by weight of wool and 20% by weight of ramie, while the weft consists of ramie threads 2. Suitable ramie fibres are available for example under the name of Firon® from Fischer Dottikon AG, CH-5606 Dottikon. Altogether, this produces a wool portion of 52% by weight and a ramie portion of 48% by weight. Of course, other compositions are possible, too, as described above.

A measurement of the capillary rise showed the woven fabric described to have values typical of an efficiently water-transporting substrate, namely:

| | Warp | Weft |
|---|---|---|
| after 1 hour | ~15 cm | ~15 cm |
| after 3 hours | >25 cm | >25 cm |

Figure 2:
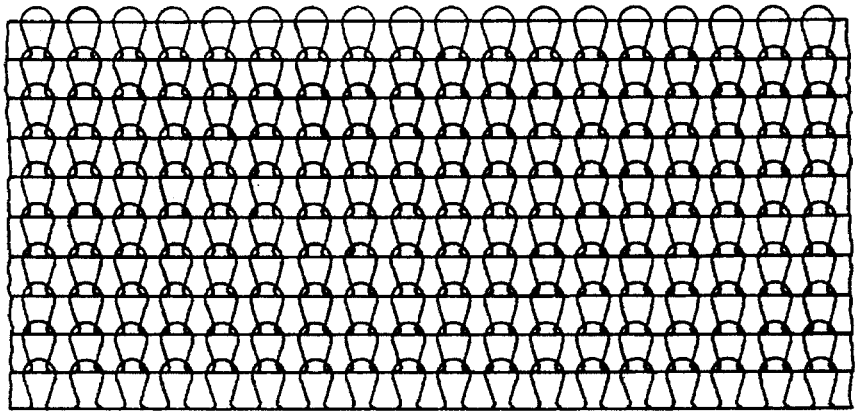
FIG. 2 shows a weft Raschel fabric.
Figure 3:
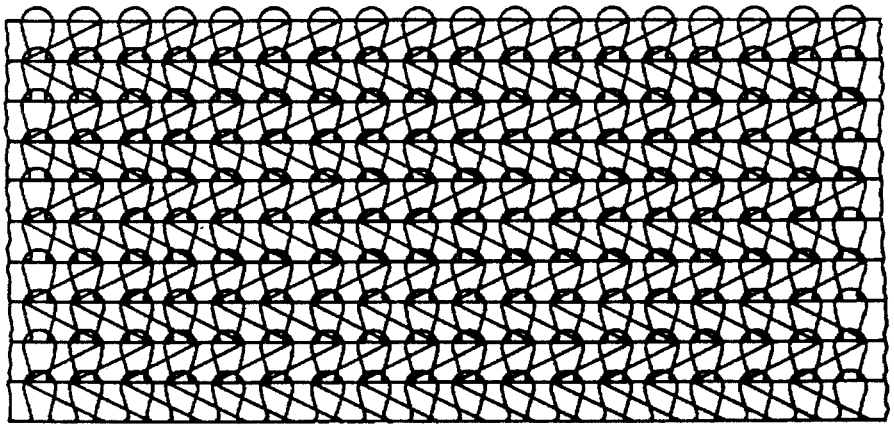
FIG. 3 shows a Malimo fabric.

FIGS. 2 and 3 show further typical substrates, FIG. 2 a weft Raschel and FIG. 3 a Malimo, which can likewise have been composed in one of the above-described ways.

I claim:

1. A textile substrate for a seat cover, having:

a wool content of at least 40 percent, by weight;

a ramie content of at least 15 percent, by weight; and a combined wool and ramie content of more than 85 percent, by weight.

2. The textile substrate of claim 1, wherein:

said wool content is 40 to 85 percent, by weight; and said ramie content is 15 to 60 percent, by weight.

3. The textile substrate of claim 1, further having:

a non-wool, non-ramie elastic fibre content of up to 5 percent, by weight.

4. The textile substrate of claim 1, further having:

a metal fibre content of up to 5 percent, by weight.

5. The textile substrate of claim 1, further having:

a polyester fibre content of less than 15 percent, by weight.

6. The textile substrate of claim 1, consisting of fibres produced by animals and plants.

7. The textile substrate of claim 1, wherein:

said combined wool and ramie content is 100 percent, by weight.

8. The textile substrate of claim 1, wherein:

said substrate is made at least in part of yarn containing a blend of wool and ramie.

9. The textile substrate of claim 8, wherein:

said yarn is made of a blend of 80 percent wool and 20 percent ramie, by weight.

10. The textile substrate of claim 8, wherein:

said substrate is a woven fabric having a warp and a weft, and said yarn provides one of said warp and said weft.

11. The textile substrate of claim 10, wherein:

the other of said warp and said weft consists of ramie.

12. The textile substrate of claim 1, wherein:

said substrate consist of materials which rot under environmental conditions of high moisture and high temperature.

* * * * *